US006729280B2

(12) United States Patent
Muraki

(10) Patent No.: US 6,729,280 B2
(45) Date of Patent: May 4, 2004

(54) REFERENCE POSITION LEARNING APPARATUS AND METHOD OF A VARIABLE VALVE-TIMING CONTROLLING SYSTEM

(75) Inventor: Hirotada Muraki, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/975,073

(22) Filed: Oct. 12, 2001

(65) Prior Publication Data

US 2002/0056424 A1 May 16, 2002

(30) Foreign Application Priority Data

Oct. 23, 2000 (JP) ..... 2000-322845

(51) Int. Cl.[7] ..... F01L 1/34

(52) U.S. Cl. ..... 123/90.15; 123/90.17; 123/90.27

(58) Field of Search ..... 123/90.15, 90.16, 123/90.17, 90.27, 90.31

(56) References Cited

U.S. PATENT DOCUMENTS 5,218,935 A 6/1993 Quinn, Jr. et al.
5,381,764 A 1/1995 Fukuma et al.
5,462,022 A * 10/1995 Ushida ..... 123/90.17
5,548,995 A * 8/1996 Clinton et al. ..... 73/116
5,937,805 A * 8/1999 Matsumura ..... 123/90.15
6,101,993 A 8/2000 Lewis et al.
6,109,224 A * 8/2000 Morikawa et al. ..... 123/90.15
6,213,067 B1 * 4/2001 Takahashi et al. ..... 123/90.15

FOREIGN PATENT DOCUMENTS

EP 0 733 782 A1 9/1996
JP 11-82073 3/1999
JP 11-062640 3/1999

* cited by examiner

*Primary Examiner*—Thomas Denion
*Assistant Examiner*—Ching Chang
(74) *Attorney, Agent, or Firm*—Foley & Lardner LLP

(57) ABSTRACT

A reference position of a camshaft used in detection of a rotational phase of the camshaft relative to an engine crankshaft during the feedback control operation of a variable valve-timing controlling system adjustably changing the valve-timing of the engine, is learned in such a manner that result of detection of the rotational phase is smoothed more effectively than when the feedback control operation of the variable valve-timing controlling system is carried out, so as absorb unequal spaces among detection subjects of the cam sensor arranged around the camshaft.

20 Claims, 9 Drawing Sheets

REFERENCE POSITION LEARNING APPARATUS AND METHOD OF A VARIABLE VALVE-TIMING CONTROLLING SYSTEM

BACKGROUND OF THE INVENTION

1. Field of the Invention

The present invention relates to a technique for learning a reference position of a camshaft in a variable valve-timing controlling system in which a rotational phase of the camshaft relative to a crankshaft of an internal combustion engine.

2. Description of the Related Art

Hitherto, a variable valve-timing controlling system for an internal combustion engine is known, in which a rotational phase of a camshaft relative to a crankshaft of the engine is varied so as to adjustably change valve timing of an intake and/or an exhaust valve of the engine (refer to Laid-open Japanese Patent Publication No. 11-082073 (JPP-'073)).

More specifically, in the variable valve timing controlling system of JPP-'073, there are provided a crank angle sensor for generating N pulse signals as per one complete rotation of the crankshaft, and a cam sensor for generating 2N pulse signals as per one complete rotation of the intake valve side camshaft, and on the basis of a relative rotational angle between the pulse signals from the crank angle sensor and the pulse signals from the cam sensor, the rotational phase of the camshaft relative to the crankshaft is detected.

Further, in the variable valve timing controlling system of JPP-'073, the relative rotational phase detected when the camshaft is at the most retardant position which is a reference position, is stored as a learned value for the most retardant position of the camshaft, to detect the rotational phase of the camshaft relative to the crankshaft with this learned value as a reference.

SUMMARY OF THE INVENTION

The aforementioned cam sensor generates 2N pulse signals as per one complete rotation of the cam shaft by detecting 2N detection subjects arranged equiangularly in the rotation direction of the camshaft. However, depending on machining errors, there may appear inequality in the angular spaces between the respective neighboring detection subjects.

If there appear any inequality in the angular spaces, even if an actual rotational phase of the camshaft relative to the crankshaft is the same, the results of detection of the rotational phase become different from each other due to the detection subjects to be used. Therefore, a problem occurs such that accuracy in the learning of the reference position of the camshaft will be unavoidably lowered.

Therefore, an object of the present invention is to provide a reference position learning apparatus and method of a variable valve timing controlling system, which is able to improve the learning accurately of a reference position for variable valve timing control (a VTC reference position) and also to ensure an appropriate responsibility in a feedback controlling of valve timing.

In order to achieve the above object, with the present invention, in a constitution where there are provided a crank angle sensor that generates a rotation-detection signal of the crankshaft, and a cam sensor that detects a plurality of detection subjects provided for the camshaft so as to be arranged in a rotating direction of the camshaft, to generates a rotation-detection signal for each of the plurality of detection subjects, and the rotational phase of the camshaft relative to the crankshaft is detected on the basis of the rotation-detection signals of the crank angle sensor and the cam sensor, to feedback control a variable valve timing system on the basis of the detected rotational phase, a rotational phase of the camshaft corresponding to a reference position of the camshaft is learned during the stopping of the feedback control and a rotational phase is detected with the learned value as a reference, and when learning the reference position, a detection result of the rotational phase is smoothened more effectively than a detection result of the rotational phase during the feedback control, to learn the rotational phase corresponding to the reference position on the basis of the smoothened detection value of the rotational phase.

The above and other objects, features and advantages of the present invention will become apparent from the following description of several preferred embodiments thereof, with reference to the accompanying drawings.

DETAILED DESCRIPTION OF THE PREFERRED EMBODIMENTS

Figure 1B:
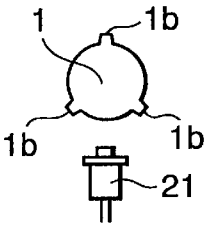
FIG. 1B is a side view taken along the line 1B—1B of FIG. 1A.
Figure 1A:
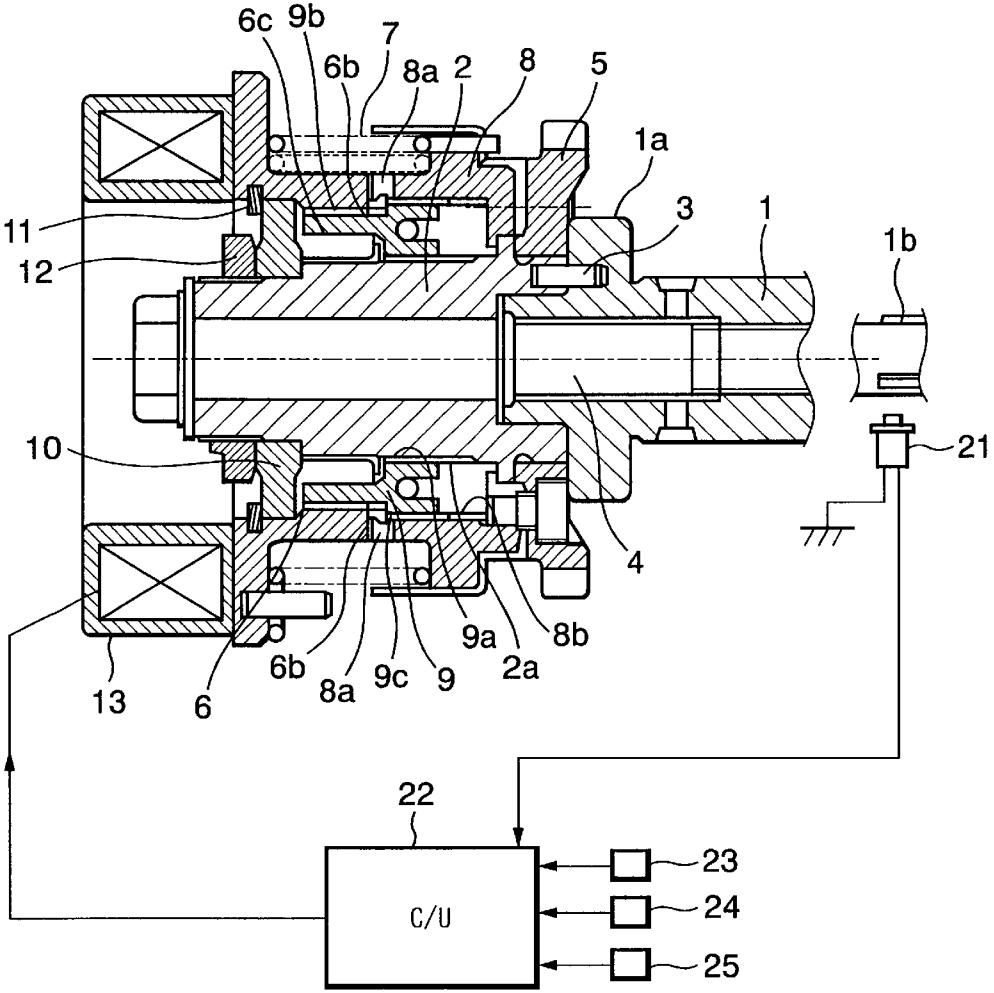
FIG. 1A is a cross-sectional view illustrating an example of a general construction of a variable valve timing controlling system with a control unit for controlling the valve timing of an internal combustion engine.
Figure 2:
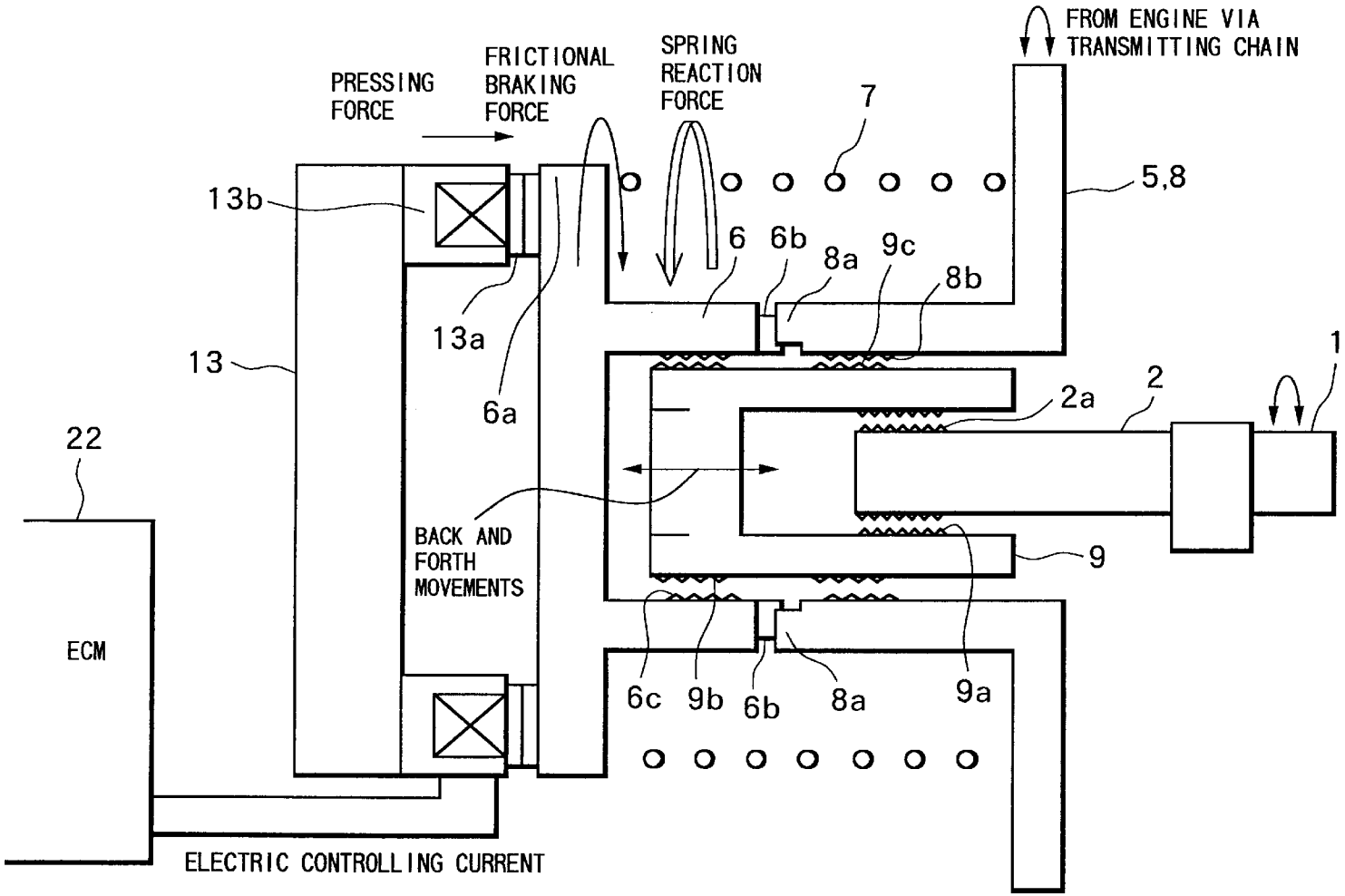
FIG. 2 is a schematically diagrammatic view, illustrating the function exhibited by the variable valve timing controlling system of FIGS. 1A and 1B.

Referring first to FIGS. 1A, 1B and 2, which illustrate a variable valve timing controlling system employing a solenoid brake, and the functions exhibited by various elements of the system, the variable valve timing controlling system has a camshaft 1 operatively connected to an internal combustion engine and supported to be able to rotate with respect to a cylinder head (not shown) of the engine.

The camshaft 1 has, at its extreme end 1*a*, a flanged portion to which a tubular motion-transmitting member 2 is non-rotatably and coaxially attached by means of connecting pins 3. The camshaft 1 and the motion-transmitting member 2 are further centrally and axially connected together by a threaded bolt 4.

A sprocket member 5 is rotatably supported around a portion of the motion-transmitting member 2, so that the sprocket member 5 may be rotated relative to the camshaft 1. Namely, the sprocket member 5 is rotationally driven when a rotating motion of a crankshaft (not shown in FIGS. 1A, 1B, and 2) of the engine is transmitted through a suitable transmitting element such as a timing chain. The rotational motion of the sprocket member 5 is further transmitted to the motion-transmitting member 2 via a transmitting mechanism as described below.

A tubular drum 6 having a flange 6*a* is coaxially arranged around the camshaft 1, and a coil spring 7 is interposed between the drum 6 and the above-mentioned sprocket member 5 in a manner such that the coil spring 7 elastically and rotationally urges the drum 6 in a direction to advance the rotational phase of the drum 6 relative to the sprocket member 5. Namely, one end (the right hand end in FIG. 1A) of the coil spring 7 is fixedly engaged with a casing member 8, which per se is fixed to the sprocket member 5, and the other end of the coil spring 7 is secured to the flange 6*a* of the drum 6. Thus, the spring force exhibited by the coil spring 7 acts so as to constantly urge the drum 6 in the above-mentioned direction.

Figure 3:
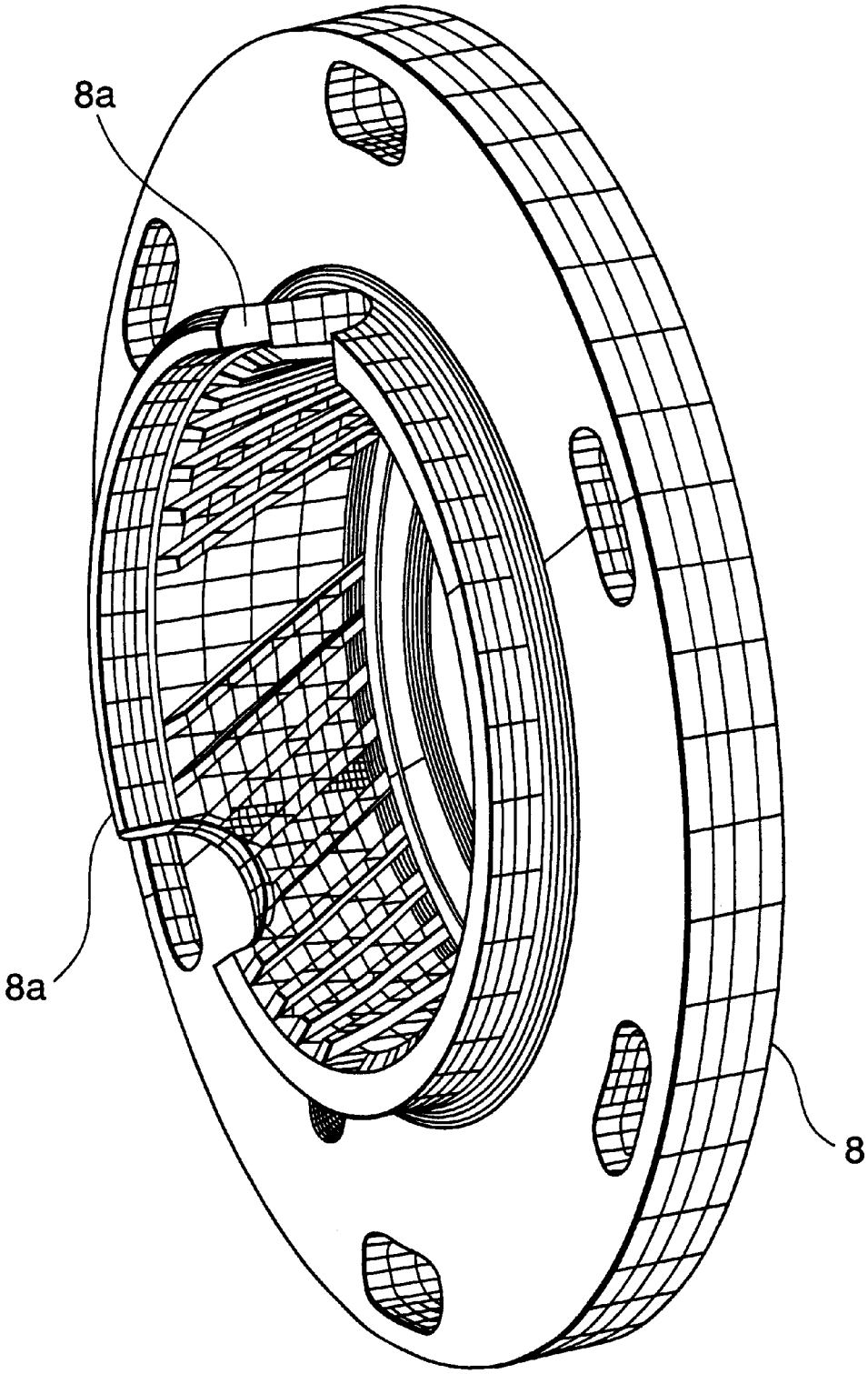
FIG. 3 is an enlarged perspective view of a stop element accommodated in the variable valve timing controlling system of FIGS. 1A and 1B, illustrating the construction of the stop element accommodated in the above-mentioned controlling system.

The drum 6 and the casing member 8 are provided with axially opposed ends opposing to one another, and the opposing ends are provided with stoppers 6*b* and 8*a*, respectively. The detailed construction of the stopper 8*a* of the casing member 8 is best shown in FIG. 3.

A tubular piston member 9 is formed therein with internal gear teeth 9*a* which are provided to be meshed with outer gear teeth 2*a* formed in an outer circumference of the above-mentioned motion-transmitting member 2. At this stage, the gear teeth 2*a* and 9*a* are preferably formed as helical gear teeth engaged helically with one another.

The piston member 9 also has three male screw threads 9*b* formed in an outer circumference of an end thereof (the left hand end of the piston member 9 in FIGS. 1A and 2). The three male screw threads 9*b* of the piston member 9 are provided so as to be threadedly engaged with three female screw threads 6*c* formed in a portion of the inner circumference of the tubular drum 6.

The piston member 9 also has gear teeth 9*c* formed in a right hand end portion of the outer circumference thereof. The gear teeth 9*c* of the piston member 9 are formed as a helical gear teeth meshed helically with helical gear teeth 8*b* formed in a portion of an inner circumference of the casing member 8.

A bearing member 10 is interposed between the outer circumference of the motion-transmitting member 10 and the inner circumference of the drum 6 so as to rotatably support these members 6 and 10 during the relative rotation therebetween. An outer end face of the drum 6 is engaged with a snap ring 11 in the form of an annular member fitted in a portion of the drum 6 and with a nut member 12 threadedly engaged with an outer circumference of an end portion of the motion-transmitting member 2, so that an axial movement of the bearing member 10 is restricted.

A solenoid brake 13 is arranged at a position located outside an extreme end (the left hand end in FIG. 1A) of the drum 6 and is fixedly supported by a body (not shown in FIGS. 1A and 2) of the engine. The solenoid brake 13 is provided with a clutch member 13*b* having an end face opposing the end face of the drum 6, and the clutch member 13*b* includes a friction member 13*a* attached to the end face thereof. When the solenoid brake 13 is electrically excited by the supply of electric current, the clutch member 13*b* is axially extended toward the end face of the flange 6*a* of the drum 6, so that the friction member 13*a* is engaged frictionally with the end face of the flange 6*a*. Thus, a brake force is frictionally applied to the drum 6 by the solenoid brake 13.

Now, the description of the basic operation of the variable valve-timing controlling system will be provided below.

When the solenoid brake 13 is not supplied with any electric excitation current, the solenoid brake 13 is not excited, and accordingly no brake force is applied to the drum 6. Therefore, due to the spring force of the coil spring 7, the drum 6 is urged toward a position where the stopper 6*b* of the drum 6 is engaged with the stopper 8*a* of the casing member 8. Namely, the drum 6 is rotationally held at a position where it is restricted against movement by the engagement of the two stoppers 6*b* and 8*a*. Thus, the camshaft 1 is held at a specific position that is the most retardant position relative to the crankshaft of the engine.

When the camshaft 1 should be rotationally advanced from the above-mentioned most retardant position by an amount of a desired or target angle corresponding to a desired valve timing, an electric excitation current is supplied to the solenoid brake 13, so that a frictional brake force is applied to the flange 6*a* of the drum 6 by the clutch member 13*b*. Then, the drum 6 is rotationally retarded against the sprocket member 5, which is synchronously rotated together with the crankshaft of the engine. Therefore, the piston member 9 is axially moved from left to right in FIGS. 1A and 2, due to the threaded engagement of the male and female screw threads 9*b* and 6*c*.

Since the piston member 9 is engaged with both the casing member 8 and the motion-transmitting member 2, via the afore-mentioned engagements of the two pairs of helical gear teeth 9*a*, 2*a* and 9*c*, 8*b*, which are formed, so as to have mutually reverse helical angles. Thus, when the piston member 9 is moved in the afore-mentioned axial direction, i.e., in a direction from left to right in FIGS. 1A and 2, the motion-transmitting member 2 is angularly moved against the casing member 8 along the helical gear teeth of the above-mentioned two helical gear engagements, so that the rotational advance movement of the motion-transmitting member 2 relative to the casing member 8 occurs. Therefore, the camshaft 1 is rotated relatively to the crankshaft of the engine that rotates synchronously with the sprocket member 5.

At this stage, in the above-mentioned two pairs of helical gear teeth engagements formed by the two pairs of outer and inner helical gear teeth 9*a*, 2*a* and 9*c*, 8*b*, although one of the two helical gear engagements may be replaced with an engagement of a pair of straight spline members, the described two engagements of the two pairs of outer and inner helical gear teeth, which are formed to have mutually reverse helical angles are effective for acquiring a larger rotational advance movement of the camshaft 1 in response to a unit amount of axial movement of the piston member 9.

When the supply of the electric excitation current to the solenoid brake 13 is increased, so as to increase the frictional brake force applied by the clutch member 13*b* of the solenoid brake 13 to the drum 6 against the spring force of the coil spring 7, the rotational phase of the camshaft 1 is varied in a rotationally advance direction. Namely, when the frictional brake force applied by the solenoid brake 13 to the drum 6 is adjustably changed, the amount of rotational motion of the drum 6 relative to the sprocket member 5 can be changed in a retardant direction. Thus, the rotational phase of the camshaft 1 against the sprocket member 5, i.e., the engine crankshaft can be adjustably varied. It will now be understood from the foregoing description that the friction brake force of the solenoid brake 13 can be adjustably varied by suitably changing the supply of electric excitation current to the solenoid brake 13, and that the rotational phase of the camshaft 1, i.e., an amount of the advance movement of the camshaft 1 can be in turn varied continuously in response to the above-mentioned change in the supply of electric excitation current to the solenoid brake 13.

The adjustable control of the supply of electric excitation current to the solenoid brake 13 can be achieved by the conventional duty control method controlling the ON and OFF operation in the supply of the electric excitation current.

As best shown in FIG. 1B, the camshaft 1 or alternatively an appropriate rotary member fixedly connected to the camshaft 1 is provided with a plurality of projections 1*b* equiangularly formed therearound to be detected by a later-described sensing means. The number of the projections 1*b* for detection formed around the camshaft 1 is selected so as to correspond to the number of cylinders of the internal combustion engine. For example, when the engine consists of a V-6 engine having six cylinders, the two camshafts 1 are arranged in a manner such that each camshaft 1 is provided for each of the left and right banks of the engine. Therefore, each of the two camshafts 1 is provided with three projections 1*b* equiangularly arranged at each 120° space. The projections 1*b* of each camshaft 1 are detected by a cam sensor 21, which generates an electric pulse signal upon detection of each projection 1*b* during 10 the rotation of the camshaft 1.

The variable valve-timing controlling system is provided with a control unit 22 including therein an electronic microcomputer. The control unit 22 is electrically connected to the above-mentioned solenoid brake 13 so as to control the supply of the electric excitation current to the brake 13. As a result, the control unit 22 can control the valve timing of the intake and/or the exhaust valves (not shown in FIGS. 1A and 2) of the engine. The control unit 22 is also electrically connected to the above-mentioned cam sensor 21 of each camshaft 1, as shown in FIG. 1A, to receive the pulse signals from the cam sensor 21.

The control unit 22 is further electrically connected to an air-flow meter 23 detecting the amount of intake air entering the engine, a crank angle sensor 24 detecting the rotational angle of the crankshaft of the engine, and a temperature sensor 25 detecting the temperature of the cooling water of the engine in order to receive detected signals from these sensors.

The control unit 22 receiving the detected signals from respective sensors 21, 23, 24 and 25, detects the operating conditions of the engine, which include the engine rotating speed, the engine load, and the cooling water temperature, on the basis of the detected signals. Then, on the basis of the detected operating conditions of the engine, the control unit 22 conducts setting of a desired valve timing of the intake and/or exhaust valves of the engine.

More specifically, on the basis of the signals from the crank angle sensor 24 and each cam sensor 21, the control unit 22 detects the rotational phase of the camshaft 1, i.e., the amount of advance of the camshaft 1 relative to the crankshaft of the engine. Then, the control unit 22 controls the supply of electric excitation current to the solenoid brake 13 in a feedback control manner, so that the above-mentioned detected rotational phase of the camshaft 1 coincides with a desired rotational phase corresponding to the above-mentioned desired valve timing.

Figure 4:
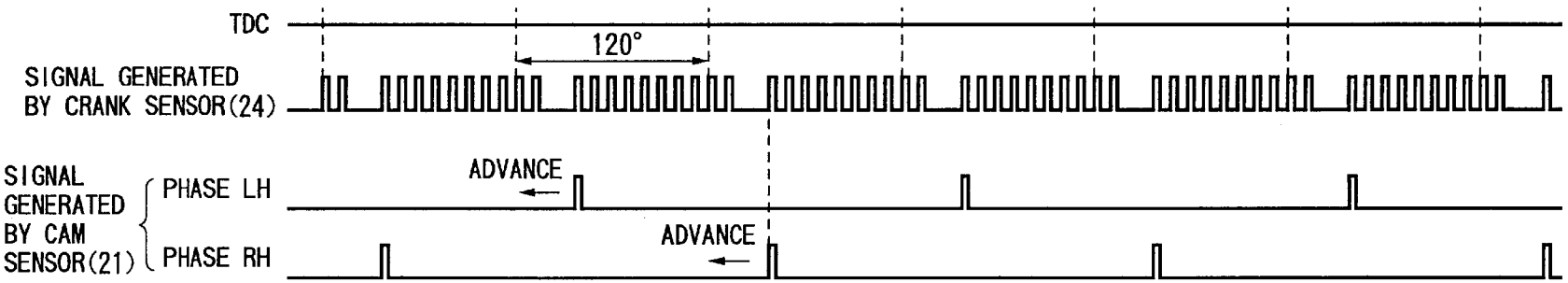
FIG. 4 is a time chart illustrating signals outputted by a crank angle sensor and a cam sensor of the variable valve timing controlling system of FIGS. 1A and 1B.

As best shown in FIG. 4, the crank sensor 24 generates and outputs an electric pulse signal for every 10 degrees of the crank angle that is a unit crank angle during the rotation of the crankshaft. However, the sensor 24 is preliminarily formed so that it does not generates any pulse signal at three positions spaced 120 degrees apart from one another around the crankshaft as per every one complete rotation of the crankshaft.

Further, FIG. 4 indicates both of the outputs from the two cam sensors 21 provided on the left and right banks of the V-6 engine. Namely, the output pulse signals identified by LH indicates those outputted by the cam sensor 21 on the left bank, and the signals identified by RH indicates those outputted by the cam sensor 21 on the right bank.

The control unit 22 operates so as to constantly measure the cycle of generation of the pulse signals from the crank angle sensor 24, and on the basis of the ratio between the newest value of the cycle of generation of the pulse signals and the value at the previous time, the control unit 22 detects the above-mentioned three positions, i.e., signal-void positions, where the sensor 24 does not generate the pulse signals. Then, on the basis of the detection of the three signal-void positions, the control unit 22 detects each pulse generative position, which occurs immediately after each of the three signal-void positions, as a reference crank angle position of every one of the engine cylinders (six cylinders in the shown example).

The control unit 22 further operates so as to measure an angle between the detected reference crank angle position and the position of each pulse signal generated by the cam sensor 21, and perceives the measured angle as an angular value indicating the rotational phase (the advance angle) of the camshaft 1 relative to the engine crankshaft.

At this stage, an angular value that the control unit 22 measures when the camshaft 1 stays at its most retardant position due to no excitation of the solenoid brake 13, e.g., at the time of engine starting, is learned by the control unit 22 per se as a specific data of the rotational phase of the camshaft 1 at its reference position. Then, on the basis of the learned specific angular value at the reference position of the camshaft 1, detection of various rotational phases of the camshaft 1 (the various angular amounts of advance) are carried out by the actual measurements to obtain actual rotational phase data at the actual measuring times, and a controlling of the supply of electric excitation current to the solenoid brake 13 is conducted in the feedback control manner, so that the obtained actual rotational phase data coincide with the target rotational phase data corresponding to respective desired valve timings.

At this stage, the above-mentioned data of the rotational phase are subjected to a smoothing process before they are used for learning of the reference position of the camshaft 1 and for conducting the feedback control of the desired valve timings.

The description of the data smoothing process and the learning process of the reference position of the camshaft 1 implemented by the microcomputer of the control unit 22 is now provided hereinbelow.

Figure 5:
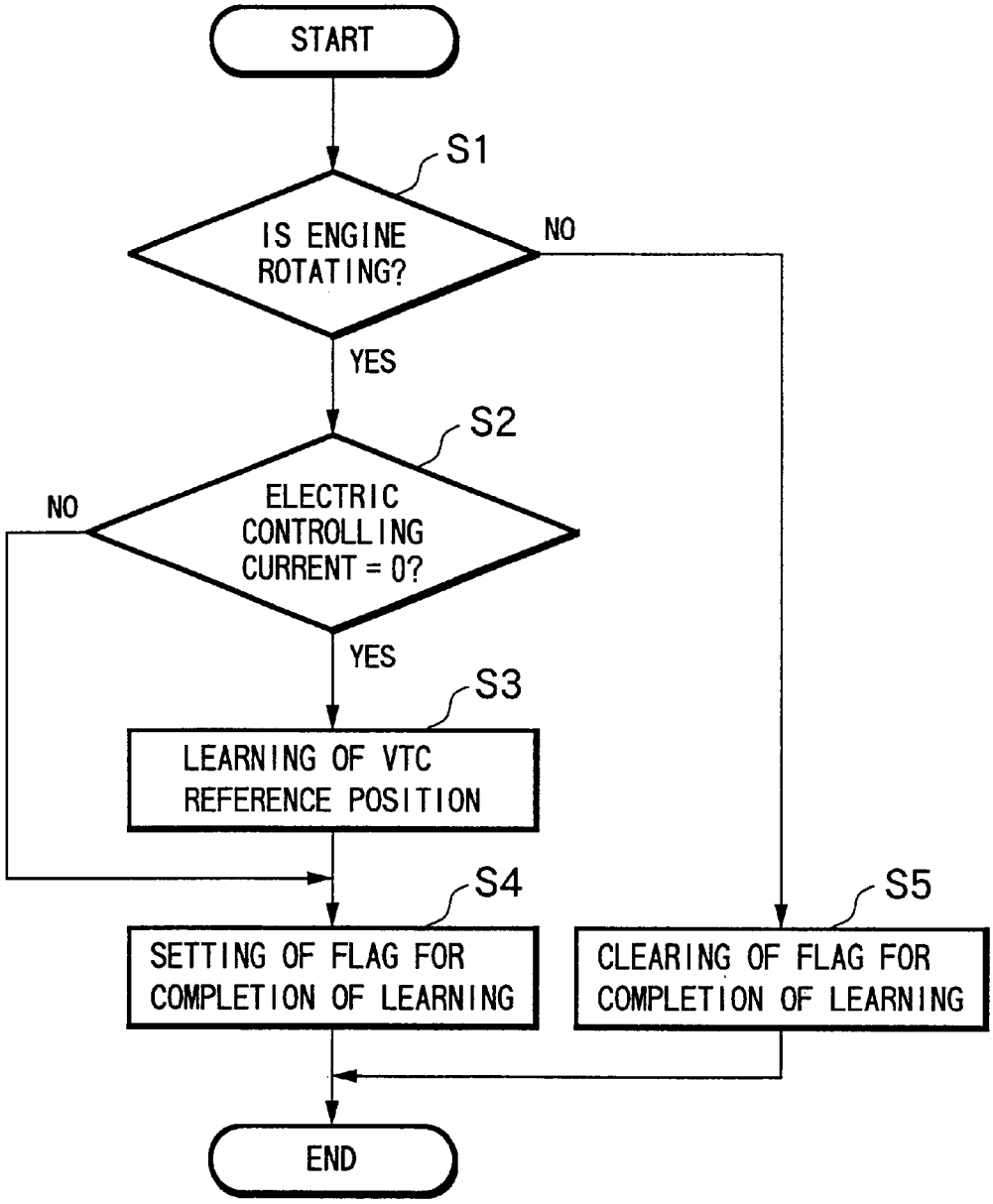
FIG. 5 is a flow chart illustrating a main routine of a controlling process for the control of the reference position learning of the camshaft.

Referring to FIG. 5, which illustrates the controlling process for the learning of the camshaft reference position, it is detected in Step 1 whether or not the engine is rotated. When it is detected that the engine is rotated (YES), the process is forwarded to Step 2, where it is detected whether or not the supply of the electric excitation current to the solenoid brake 13 is stopped.

When it is detected in Step 2 that the above-mentioned supply of the electric excitation current to the solenoid brake 13 is stopped (YES) and that the camshaft 1 is maintained at the most retardant position, the control unit 22 understands that a condition for learning the reference position of the camshaft 1 (the VTC reference position) is established, and the control process is forwarded to Step 3 to implement the learning of the reference position.

In the learning of the camshaft reference position in Step 3, the storing of a learned value BASVT of the reference position is carried out by storing a value VTCNOW of the amount of advance of the camshaft 1 which is smoothed by the weighed mean method while employing a later-described weighing factor for the learning.

When the learning of the camshaft reference position is completed, the process is forwarded to Step 4 where setting of a flag for the completion of the learning is implemented.

On the other hand, in Step 1, when it is detected that the engine is not rotated, the process is directly forwarded to Step 5, to conduct clearing of the above-mentioned flag for the completion of the learning.

Also, when it is detected in Step 2 that the supply of the electric excitation current to the solenoid brake 13 is not performed, the process is forwarded to Step 4, to maintain the newest learned value BASVTC.

Figure 6:
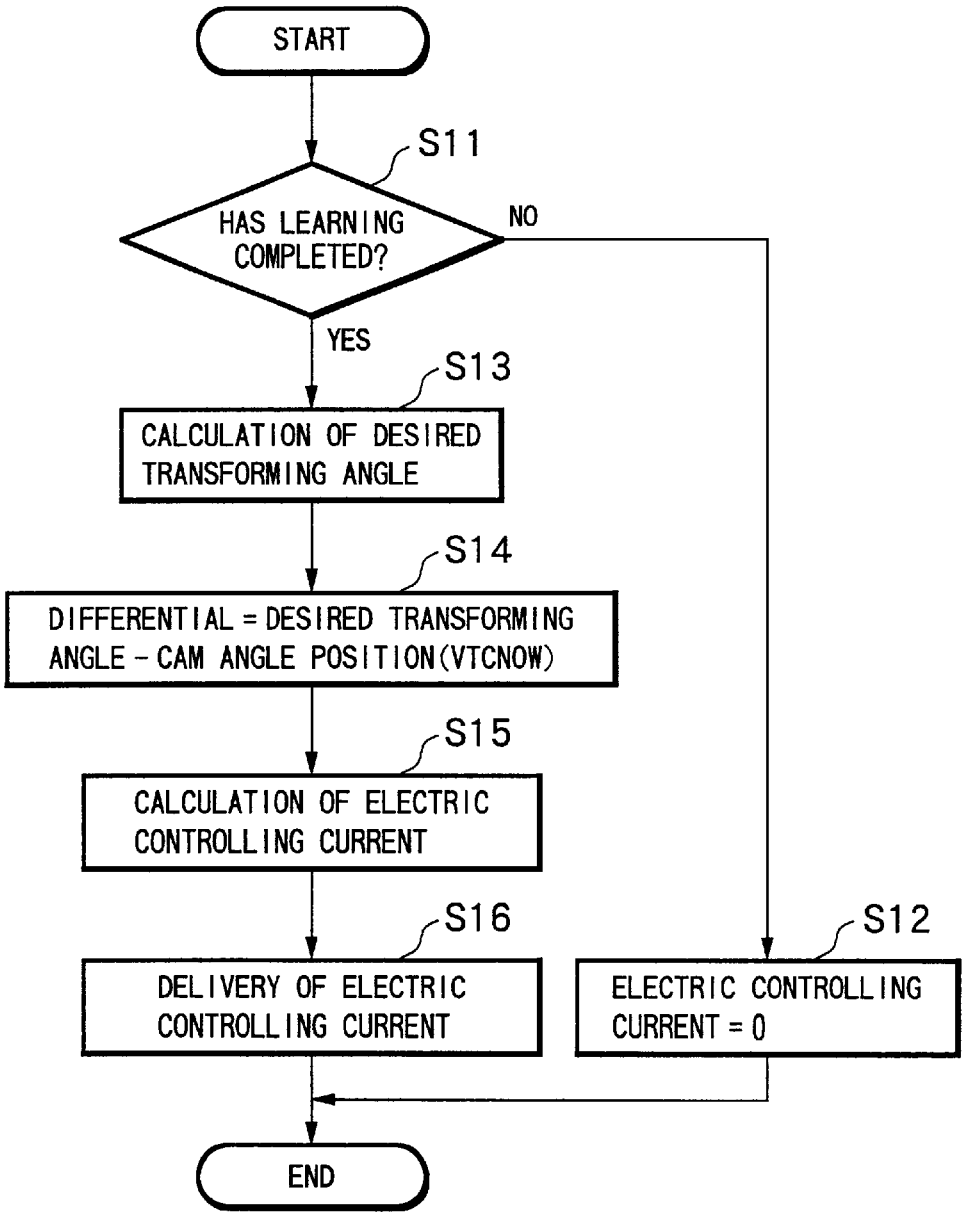
FIG. 6 is a flow chart illustrating a controlling process for the control of an electric control current supplied to a solenoid brake, which is an important constituent of the variable valve timing controlling system of FIGS. 1A and 1B.

FIG. 6 is a flow chart illustrating a process for controlling the supply of electric excitation current to the solenoid brake 13 when the feedback control of the valve timing of the engine is carried out.

In the flow chart of FIG. 6, it is detected in Step 11 whether or not the afore-mentioned learning of the camshaft reference position has been completed, on the basis of the flag for the completion of the VTC reference position learning.

When it is detected that the learning of the VTC reference position has not yet been completed, the process is forwarded to Step 12 to stop the supply of electric excitation current to the solenoid brake 13. Thus, the camshaft 1 is maintained at the most retardant position thereof irrespective of the operation of the engine.

On the other hand, when it is detected that the learning of the camshaft reference position has been completed, the process is forwarded to Step 13 to calculate a desired rotational phase of the camshaft 1.

During the calculation, a basic amount of the desired rotational phase is initially obtained on the basis of the rotating speed of the engine and the engine load, and thereafter the obtained basic amount is corrected by considering the other operating condition such as the cooling water temperature. Then, the corrected amount is set as a final data of the desired rotational phase of the camshaft 1. The setting of the final data is labeled as "calculation of a desired transforming angle" in the flow chart of FIG. 6.

In Step 14, a differential of an actually detected rotational phase (i.e., the amount of advance of the camshaft 1 against the VTC reference position thereof) from the above desired rotational phase is calculated. At this stage, as described later, the camshaft advance amount VTCNOW that is smoothed by the weighed mean method employing a weighing factor for the feedback control is used as the actually detected rotational phase.

Figure 7:
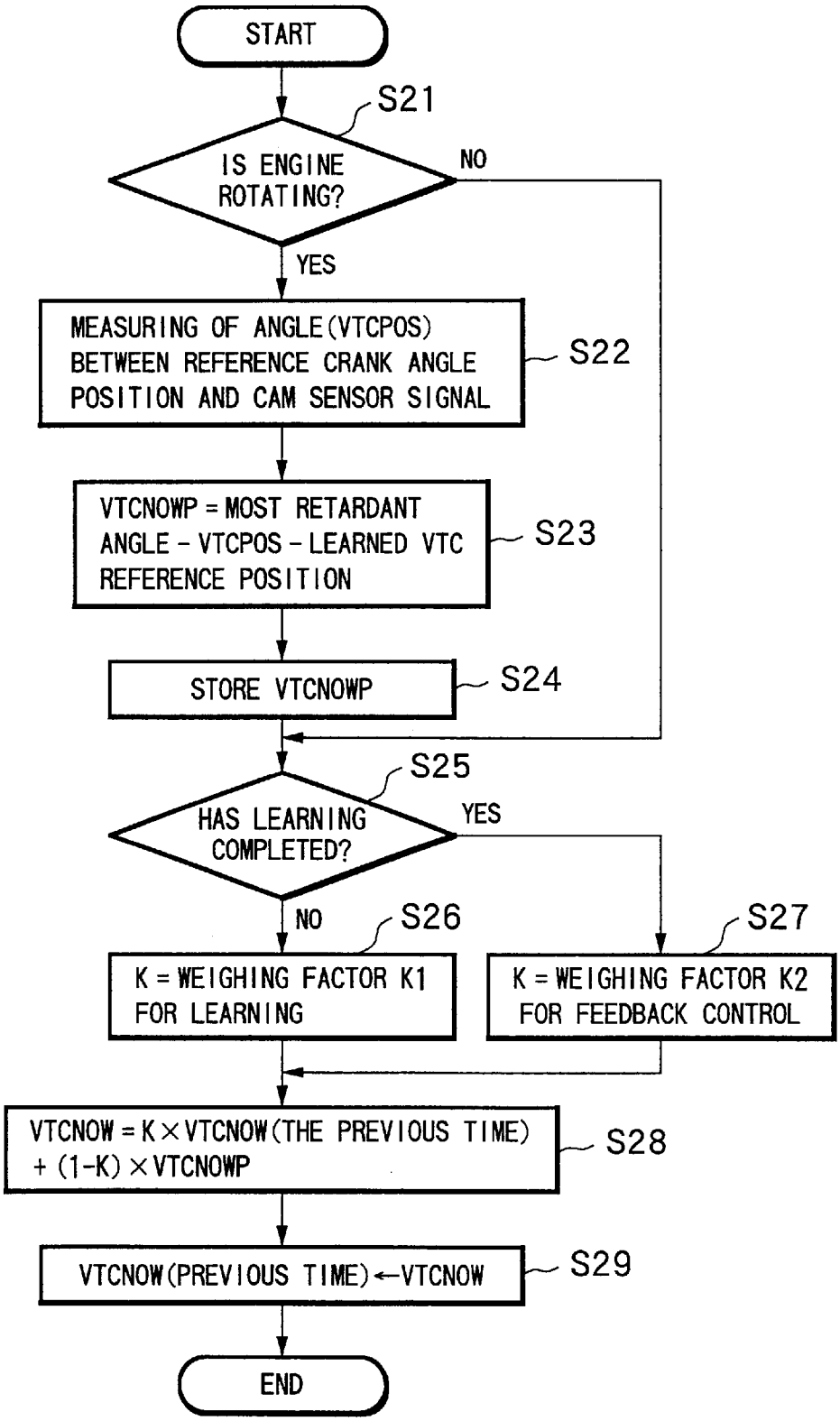
FIG. 7 is a flow chart illustrating a first embodiment of the reference position learning method according to the present invention.

In Step 15, a controlling value for the supply of electric excitation current to the solenoid brake 13 is calculated. Namely, a feedback control of the controlling value (the duty signal) for the supply of electric excitation current is conducted by using the PI control method, on the basis of the above-mentioned differential. Then, in Step 16, the calculated controlling value for the supply of electric excitation current is outputted to the solenoid brake 13. FIG. 7 is a flow chart illustrates a process for successively detecting the camshaft advance amounts VTCNOWP while subjecting these amounts to the processing of smoothing, based on the signals supplied by the afore-mentioned crank angle sensor 24 and the cam sensors 21. Namely, the flow chart of FIG. 7 illustrates the first embodiment of the present invention.

In Step 21 of the flow chart of FIG. 7, it is detected whether or not the engine is rotated, and when the engine is rotated (YES), the process is forwarder to Step 22.

In Step 22, a crank angle change VTCPOS from the time when detection of the reference crank angle position of every engine cylinder is made on the basis of the above-mentioned signals of the crank angle sensor 24 to the time when the signals of the cam sensors 21 are outputted is measured based on the number of signals outputted by the crank angle sensor 21.

In Step 23, the calculation of the camshaft advance amount is implemented according to the equation below.

*VTCNOWP*=the most retardant angle−*VTCPOS*−the learned value of the reference position At this stage, the most retardant angle is an angular value corresponding to the above-mentioned crank angle VTCPOS when the camshaft 1 stays at the most retardant position (the reference position of the camshaft). The most retardant angle is preliminarily stored as a fixed value, and is suitably corrected in accordance with the actual reference positions through the calculation of a value of [the most retardant angle—the learned values of the reference position].

Figure 8:
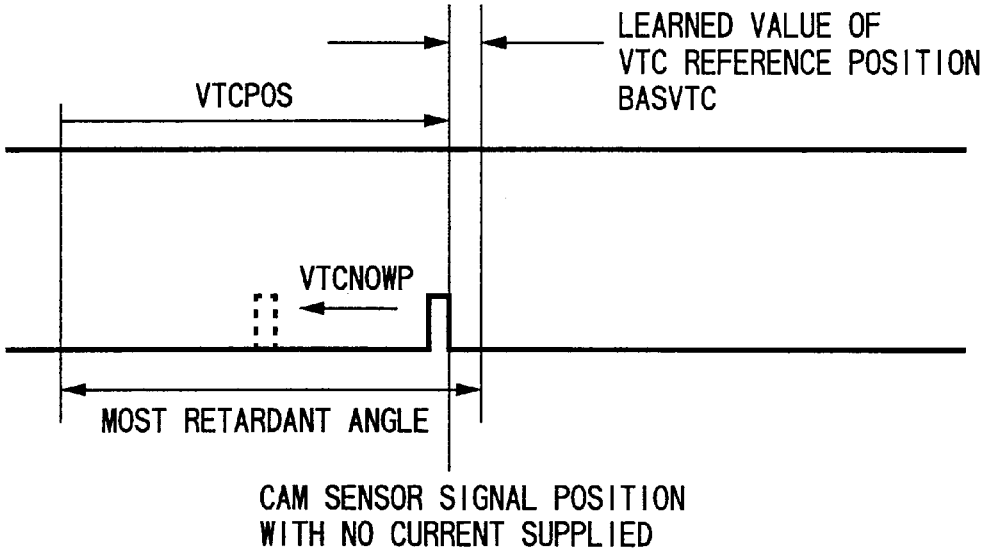
FIG. 8 is a time chart illustrating a method of detecting various cam positions.

As described above, the value of [the most retardant angle—the learned values of the reference position] indicates an angle between the reference crank position at the actual camshaft reference position (the most retardant position of the camshaft) to the position where a signal is outputted or delivered by the cam sensor 21, and thus, the value of [the most retardant angle—the learned values of the reference position] at the most retardant position of the camshaft is equal to VTCPOS. The VTCPOS becomes smaller in response to the advancing of the camshaft position. Therefore, a value obtained by subtracting the VTCPOS from the value of [the most retardant angle—the learned values of the reference position] indicates the amount of advance for the actual camshaft reference position (refer to FIG. 8).

Further, when the learning of the reference position has not yet been complete during the instant operation of the engine, the initial value of the learned reference position value is set at either zero (0) or a value obtained by storing the learned reference position value during the engine operation at the previous time.

In Step 24, the successively detected values VTCNOWP of the camshaft advance are temporarily stored in the memory of the control unit 22. In Step 25, it is detected whether or not the learning of the camshaft reference position has been completed on the basis of the value of the flag for completion of the learning that was set in the process of the afore-described flow chart of FIG. 5.

When it is detected in Step 25 that the learning of the camshaft reference position has not yet been completed, the process is forwarded to Step 26 in which a factor K1 for the VTC reference position learning is set as a weighing factor K1 (K=K1) that is used in the weighed mean operation implemented for the smoothing process.

On the other hand, when it is detected in Step 25 that the learning of the VTC reference position has been already completed, the process is forwarded to Step 27 in which a factor K2 for the feedback control is set as a weighing factor (K=K2) that is used in the weighed mean operation implemented for the smoothing process.

At this stage, the factor K1 for the VTC reference position learning is set larger than the factor K2 for the feedback control. Thus, the more large the weighing factor K is, the more large the weighing effect on the value of the previous time, and accordingly the smoothing of the camshaft advance values processed by employing the factor K1 is more effective or stronger than that processed by the feedback control while employing the factor K2, in the VTC reference position learning.

In Step 28, the smoothing process of the camshaft advance values VTCNOWP is implemented by the weighed mean operation while employing the weighing factor K, the value of which is changeably set in response to the above-mentioned change in the processing condition. More specifically, Step 28 is carried out by the following equation, i.e., $$VTCNOW=K\times VTCNOW \text{ (the value of the previous time)}+(1-K)\times VTCNOWP$$

In Step 29, the instant camshaft advance value VTCNOW calculated in Step 26 is stored for the use in the calculation of the next time as the previous value.

In accordance with the afore-described process of the present invention, when the learning of the camshaft reference position is implemented, the smoothing of the detected camshaft advance values VTCNOWP can be implemented more effective due to setting of a larger weighing factor K, and accordingly a very accurate learning of the camshaft reference position can be achieved while absorbing any inaccuracy in the camshaft reference position (the most retardant position of the camshaft) and any unequal spacing appearing among the plurality of projections 1*b* for detection.

On the other hand, in the feedback controlling of the supply of electric excitation current to the solenoid brake, the smoothing of the detected camshaft advance values VTCNOWP can be implemented relatively less effective due to setting of a smaller weighing factor K, and accordingly a better responsibility in the detection of a change in the rotational phase of the camshaft can be obtained. Therefore, the controlling of the valve timing for obtaining a desired valve timing can be stably achieved by the feedback control technique under a higher responsibility.

Now, the description of the second embodiment of the present invention is provided below with reference to the flow chart of FIG. 9. However, the flow charts of FIGS. 5 and 6 used in the description of the first embodiment will be re-used in connection with the second embodiment.

Figure 9:
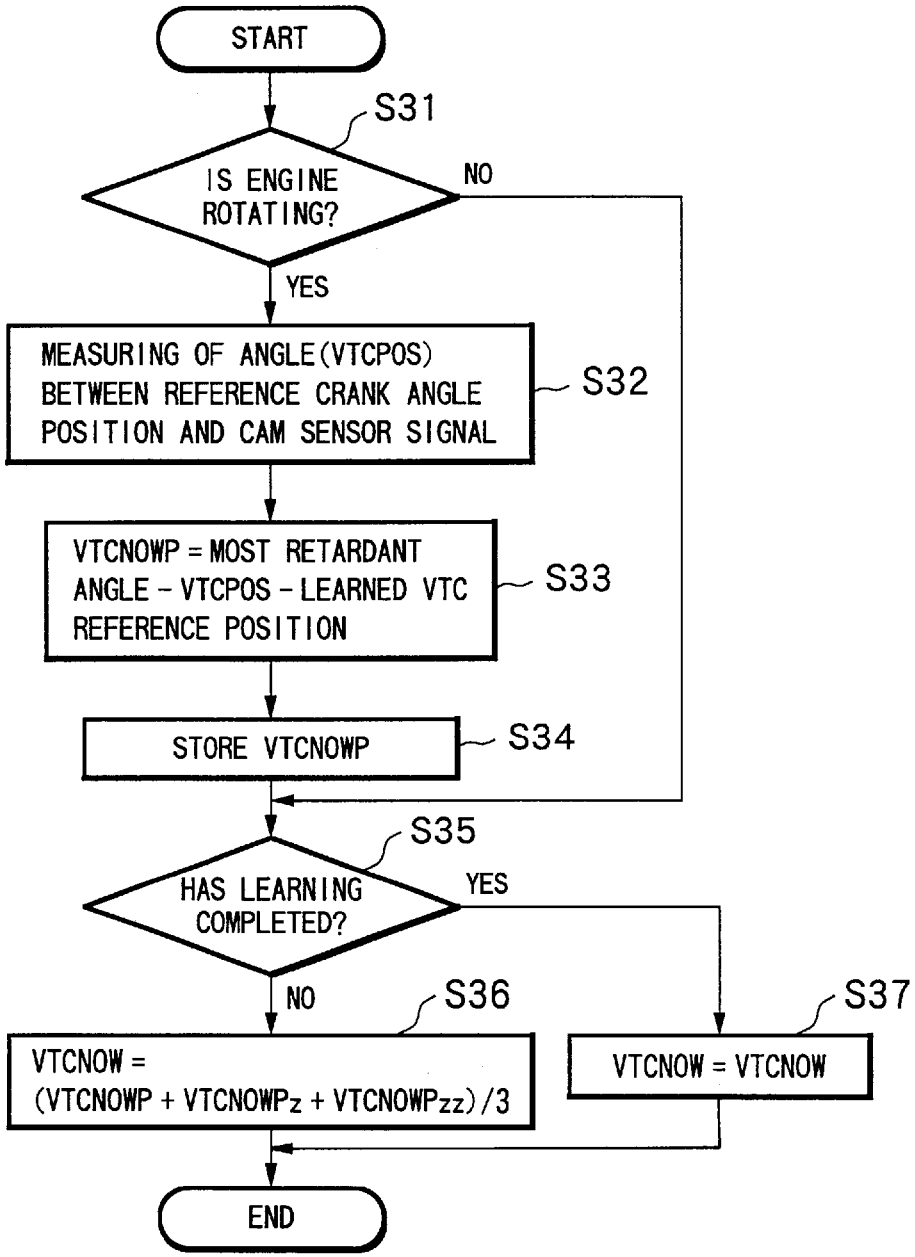
FIG. 9 is a flow chart illustrating a second embodiment of the reference position learning method according to the present invention.

Now, FIG. 9 is a flow chart illustrating the process for successively detecting camshaft advance values VTCNOWP and for the smoothing of these detected values according to the second embodiment.

In Steps 31 through 33 of the flow chart of FIG. 9 is the same as Steps 21 through 23 of the flow chart of FIG. 7.

In Step 34, the storing of the camshaft advance value VTCNOWP is carried out. However, in this embodiment, three detected values, i.e., the past two detected values (VTCNOWPz and VTCNOWPzz) in addition to the instant newest value (VTCNOWP) are stored.

It should be understood that, in this second embodiment the number of the projections 1*b* for detection by the cam sensor 21 are three that corresponds to the number of the engine cylinder. Further, the camshaft position VTCNOWP is detected at every one of the three projections 1*b*for detection. That is to say, the above-mentioned tree detected values VTCNOWP, VTCNOWPz and VTCNOWPzz at the newest time and the two past times correspond to the detected values at each of the three projections 1*b* for detection.

In Step 35, it is detected whether or not the learning of the reference position of the camshaft has been completed. When it is detected that the learning of the reference position of the camshaft has not yet been completed, the process is forwarded to Step 36 in which the process of smoothing is carried out for obtaining the mean value of the above-mentioned three detected values VTCNOWP, VTCNOWPz and VTCNOWPzz.

On the other hand, in Step 35, when it is detected that the learning of the reference position of the camshaft has already been completed, the process is forwarded to Step 37 in which the newest detected value VTCNOWP detected in Step 34 is set as the camshaft advance value VTCNOW. Namely, after the completion of the learning of the camshaft reference position, the process of smoothing is stopped, and the non-smoothed camshaft advance value VTCNOW is directly used in the feedback control in Step 13 of FIG. 6.

As described above, in accordance with the second embodiment of the present invention, the learning value of the camshaft reference position is obtained by subjecting the three detected values, which are obtained by detecting every one of the three projections 1*b* by the cam sensor 21, to the smoothing process to obtain a mean value of the three detected values. Thus, any inaccuracy in the reference position (the most retardant position of the camshaft) and an unequal spacing among the projections 1*b* detected by the cam sensor 21 can be absorbed so as to achieve an accurate learning of the camshaft reference position.

On the other hand, in the feedback control of the supply of the electric excitation current to the solenoid brake 13, the smoothing process is stopped, so that a better responsibility in the detection of a change in the rotational phase of the camshaft can be obtained. Therefore, the feedback control of the valve timing for obtaining desired valve timing can be stably achieved with a higher responsibility.

It should be noted that the above-mentioned process for learning the camshaft reference position might alternatively be achieved in a manner such that the three newest detected values of each of the three projections 1*b* are firstly averaged to obtain an averaged newest detected value, and thereafter the averaged newest detected value and the detected values at the previous times are processed by the weighed mean method to obtain the learning value of the camshaft reference position.

Further, in another alternative embodiment, the detected values of the plurality of projections 1*b* detected by the cam sensor 21 at the respective projections 1*b* are first subjected to the weighed mean process as per each projection 1*b*, and then all of the weighed mean values of respective projections 1*b* are averaged before obtaining the learned value of the camshaft reference position.

In the above-described variable valve-timing controlling system employing the frictional brake force exhibited by the solenoid brake 13, the fluctuation width of the rotational phase must be estimated to be rather large in the conventional system in adjustably controlling the valve timing. Thus, the accuracy in the controlling was considerably deteriorated. However, by the application of the camshaft reference position learning according to the present invention, any fluctuation in the detection due to any unequal spacing among the plurality of projections for detection by the cam sensor 21 can be absorbed, and accordingly the accuracy in controlling of the valve timing can be surely enhanced.

Further, it should be understood that the present invention might be equally applicable to a variable valve-timing controlling system by employing a hydraulic actuator.

The entire contents of Japanese Patent Application No. 2000-322845 filed on Oct. 23, 2000 are incorporated herein by reference.

While only selected embodiments have been chosen to illustrate and describe the present invention, it will be obvious to those skilled in the art from this disclosure that various changes and modifications can be made herein without departing from the scope of the invention as defined in the appended claims.

Furthermore, the foregoing description of the preferred embodiments according to the present invention are provided for illustrative purpose only, and not for the purpose of limiting the invention as defined by the appended claims and their equivalents.

What is claimed:

1. A reference position learning apparatus of a variable valve-timing controlling system, which changes a rotational phase of a camshaft relative to a crankshaft of an engine to control valve timing of the engine, comprising:

a crank angle sensor that generates a rotation-detection signal of the crankshaft;

a cam sensor that detects a plurality of detection subjects provided for the camshaft so as to be arranged in a rotating direction of the camshaft, to generate a rotation-detection signal for each of the plurality of detection subjects; and a control unit for determining a rotational phase for use during learning of said camshaft reference position based on a detected current rotational phase and at least a detected previous rotational phase, wherein a degree of smoothening of said current rotational phase applied during determination of said rotational phase being dependent on at least one of the number of previous rotational phases taken into account and a weighing factor assigned to said previous rotational phase and wherein the degree of smoothening of said current rotational phase being larger during learning of said camshaft reference position compared to a smoothening degree applied to a current rotational phase in determining a camshaft rotational phase during a valve timing control.

2. The reference position learning apparatus of the variable valve-timing controlling system according to claim 1, wherein the control unit detects a reference crank angle position on the basis of the rotation-detection signal of the crank angle sensor, and measures an angle from the detected reference crank angle position through the rotation-detection signal of the cam sensor as the rotational phase of the camshaft relative to the crankshaft.

3. The reference position learning apparatus of the variable valve-timing controlling system according to claim 1, wherein the crank angle sensor is provided for generating the rotation-detection signal for every unit of crank angle and for generating a void of the rotation-detection signal at every position corresponding to a reference crank angle position of the engine during the rotation of the crankshaft, and wherein the control unit detects the void of the rotation-detection signal of the crank sensor via a measurement of cycle of generation of the rotation-detection signal of the crank sensor, to thereby detect a reference crank angle position on the basis of the detected void.

4. The reference position learning apparatus of the variable valve-timing controlling system according to claim 1, wherein the control unit conducts smoothing of the result of the detection of the rotational phase during learning of the reference position of the camshaft, but conducts no smoothing of the result of the detection of the rotational phase during the feedback control of the valve-timing.

5. The reference position learning apparatus of the variable valve-timing controlling system according to claim 4, wherein the control unit conducts the smoothing of the result of the detection of the rotational phase through conducting a mean operation of data of newest rotational phases of the camshaft relative to the crankshaft, which are detected on the basis of respective one of a plurality of detection subjects of the cam sensor.

6. The reference position learning apparatus of the variable valve-timing controlling system according to claim 1, wherein the control unit conducts smoothing of result of detection of the rotational phase by means of a smoothing operation via a weighed mean operation of a newest value of detection of the rotational phase and the past value of detection of the rotational phase.

7. The reference position learning apparatus of the variable valve-timing controlling system according to claim 6, wherein the control unit changes a weighing factor used for the weighed mean operation, in response to a change from the learning of the reference position of the camshaft to the feedback control of the valve-timing and vice versa.

8. The reference position learning apparatus of the variable valve-timing controlling system according to claim 1, wherein the control unit conducts smoothing of the result of the detection of the rotational phase by means of smoothing of newest rotational phase detected on the basis of respective one of a plurality of detection subjects of the cam sensor and by means of a weighed means operation of the newest and past values of the smoothed rotational phase.

9. The reference position learning apparatus of the variable valve-timing controlling system according to claim 1, wherein the control unit conducts smoothing of the result of the detection of the rotational phase corresponding to each of a plurality of detection subjects of the cam sensor by means of a weighed mean operation of the newest and past values of the rotational phases detected for every one of the plurality of detection subjects and by means of a mean operation of the values obtained by the weighed mean operation for the every one of the plurality of detection subjects.

10. The reference position learning apparatus of the variable valve-timing controlling system according to claim 1, wherein the control unit starts the feedback control of the valve timing after completion of the learning of the reference position.

11. The reference position learning apparatus of the variable valve-timing controlling system according to claim 1, wherein the control unit conducts the learning of the reference position of the camshaft by perceiving a position where a rotation of the camshaft relative to the crankshaft is prevented by a stopper, to be the reference position of the camshaft.

12. The reference position learning apparatus of the variable valve-timing controlling system according to claim 1, wherein the variable valve-timing controlling system comprises a solenoid brake able to exhibit a frictionally braking action which permits the camshaft to change the rotational phase thereof relative to the crankshaft.

13. A reference position learning apparatus of a variable valve-timing controlling system, which learns a camshaft reference position used as a reference position in detection of a rotational phase of the camshaft relative to a crankshaft of an internal combustion engine during the controlling of a valve timing of the engine via adjustably changing the rotational phase, comprising:

a crank rotation detecting means for generating a rotation-detection signal upon detection of rotation of the crankshaft;

a cam rotation detecting means for generating rotation-detection signal upon detection of each of a plurality of detection subjects provided in a rotating direction of the camshaft;

a control means for determining a rotational phase for use during learning of said camshaft reference position based on a detected current rotational phase and at least a detected previous rotational phase, wherein a degree of smoothening of said current rotational phase applied during determination of said rotational phase being dependent on at least one of the number of previous rotational phases taken into account and a weighing factor assigned to said previous rotational phase and wherein the degree of smoothening of said current rotational phase being larger during learning of said camshaft reference position compared to a smoothening degree applied to a current rotational phase in determining a camshaft rotational phase during a valve timing control.

14. A reference position learning method of a variable valve-timing controlling system, which changes a rotational phase of a camshaft relative to a crankshaft of an engine to control valve timing of the engine, comprising:

inputting a rotation-detection signal of the crankshaft;

inputting a rotation-detection signal to be output by detecting a plurality of detection subjects;

detecting the rotational phase of the camshaft relative to the crankshaft on the basis of the rotation-detection signals of the crank angle sensor and the cam sensor;

determining a rotational phase for use during learning of said camshaft reference position based on a detected current rotational phase and at least a detected previous rotational phase, wherein a degree of smoothening of said current rotational phase applied during determination of said rotational phase being dependent on at least one of the number of previous rotational phases taken into account and a weighing factor assigned to said previous rotational phase and wherein the degree of smoothening of said current rotational phase being larger during learning of said camshaft reference position compared to a smoothening degree applied to a current rotational phase in determining a camshaft rotational phase during a valve timing control.

15. The reference position learning method according to claim 14, wherein the smoothing of the rotational phase comprises:

conducting a smoothing process of result of detection of the rotational phase during the learning of the reference position of the camshaft; and stopping the smoothing process of the result of the rotational phase during a controlling operation in the feedback control.

16. The reference position learning method according to claim 15, wherein the smoothing process during the learning of the reference position of the camshaft comprises:

conducting a mean operation of newest rotational phases detected on the basis of respective one of the plurality of detection subjects of the cam sensor.

17. The reference position learning method according to claim 14, wherein the smoothing of the rotational phase comprises:

conducting a weighed mean operation of newest and past values of the rotational phase of the camshaft relative to the crankshaft.

18. The reference position learning method according to claim 14, wherein the smoothing of the rotational phase comprises:

changing a weighing factor used for a weighed mean operation of the rotational phase of the camshaft in response to a change from the controlling operation in a feedback control manner to a preliminarily learning operation; and conducting the weighed mean operation of the newest and past values of the rotational phase of the camshaft.

19. The reference position learning method according to claim 14, wherein the smoothing of the rotational phase comprises:

conducting a mean operation of newest values of the rotational phase detected on the basis of respective one of the plurality of detection subjects of the cam sensor; and conducting a weighed mean operation of the newest values of the rotational phase subjected to the mean operation and past values of the rotational phase subjected to the mean operation.

20. The reference position learning method according to claim 14, wherein the smoothing of the rotational phase comprises:

conducting a weighed mean operation of newest and past values of the rotational phase detected for respective one of the plurality of detection subjects of the cam sensor; and conducting a mean operation of the values for the respective one of the detection subjects, obtained by the weighed mean operation.

* * * * *